US012337365B2

(12) United States Patent
Benedetti et al.

(10) Patent No.: US 12,337,365 B2
(45) Date of Patent: Jun. 24, 2025

(54) PLANT AND METHOD FOR PRODUCING FLAT ROLLED PRODUCTS

(71) Applicant: Danieli & C. Officine Meccaniche S.p.A., Buttrio (IT)

(72) Inventors: Gianpietro Benedetti, Tricesimo (IT); Paolo Bobig, San Canzian d'Isonzo (IT); Matteo Remy Bulfone, Colloredo di Monte Albano (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 223 days.

(21) Appl. No.: 18/100,701

(22) Filed: Jan. 24, 2023

(65) Prior Publication Data

US 2024/0157416 A1 May 16, 2024

(51) Int. Cl.
*B21B 1/26* (2006.01)

(52) U.S. Cl.
CPC ..... *B21B 1/26* (2013.01)

(58) Field of Classification Search
CPC ..... B21B 1/26; B21B 2001/225; B21B 1/32; B21B 1/34; B21B 37/74; B21B 45/004
See application file for complete search history.

(56) References Cited

U.S. PATENT DOCUMENTS 5,991,991 A * 11/1999 Pleschiutschnigg .... B21B 1/466 72/202
6,182,490 B1 * 2/2001 Ginzburg ..... B21B 1/34 72/200
10,576,520 B1 * 3/2020 Benedetti ..... B21B 13/22
11,674,197 B2 * 6/2023 Vignolo ..... C21D 8/0226 148/541
2010/0275667 A1 * 11/2010 Seidel ..... B21B 1/46 72/127

FOREIGN PATENT DOCUMENTS

DE 202011050499 U1 * 8/2011

* cited by examiner

*Primary Examiner* — Edward T Tolan
(74) *Attorney, Agent, or Firm* — Panitch Schwarze Belisario & Nadel LLP

(57) ABSTRACT

A plant and a method for producing a final strip starting from a slab having a determinate starting thickness, including: at least one heating furnace configured to heat at least the slab to a determinate starting temperature; at least one reversible roughing stand configured to subject the slab to one or more rolling passes in order to obtain an intermediate rolled product; and a continuous rolling train disposed operatively in line with the roughing stand and configured to reduce the thickness of the intermediate rolled product, until the final strip having a determinate final thickness is obtained.

9 Claims, 6 Drawing Sheets

PLANT AND METHOD FOR PRODUCING FLAT ROLLED PRODUCTS

CROSS-REFERENCE TO RELATED APPLICATIONS

This application claims priority under 35 U.S.C. § 119 (b) to Italian Application No. 102022000023295, filed Nov. 11, 2022, the disclosures of each of which are incorporated herein by reference.

FIELD OF THE INVENTION

The present invention concerns a plant and a method for producing flat rolled products such as, for example, but not limited to, steel strip wound in the form of reels or coils.

BACKGROUND OF THE INVENTION

Rolling plants known as Hot Strip Mills, or more simply indicated hereafter by the acronym "HSM", are known, designed for the hot production of metal strip starting from slabs typically from about 150 mm to about 350 mm thick.

Two examples of such plants are shown schematically in FIGS. 1 and 2.

These plants comprise gas heating furnaces 91 of the "Walking Beam" type in which the slabs are heated and, in line, one or two roughing stands 92, usually reversible. In the case where they comprise a single roughing stand 92 (FIG. 1) the stand generally performs from five to seven rolling passes while, in the case where they comprise two roughing stands 92 (FIG. 2), the first generally performs three rolling passes while the second performs from three to five further rolling passes in order to obtain an intermediate bar having a thickness comprised between about 35 mm and about 45 mm.

Downstream of the reversible stands 92 there is provided a transfer table, for example provided with passive insulated hoods 99 (FIG. 2), that is, without heating burners, to limit the heat losses from the intermediate bar, or a coilbox 93 is provided (FIG. 1), which allows to wind and unwind the intermediate bar.

Downstream of the transfer table, or of the coilbox 93, there is a compact rolling train, or finishing train 94, having six or seven finishing stands, an outlet table 95, also called run-out table, provided with cooling showers 96 and two or more winding reels 98 (downcoilers) which wind the finished strip to form the reels or coils.

In order for the rolling in the finishing train 94 to take place in the austenitic range, that is, without phase transformations in the structure of the steel, the strip has to leave the last stand of the finishing train 94 at a temperature not lower than 830° C.

Therefore, the rolling mass flow in the finishing train 94 has to be set to obtain said optimum temperature of at least 830° C. at the outlet of the last finishing stand.

It is also known that the rolling mass flow is calculated as the product of the thickness of the strip and its rolling speed. Therefore, when a certain rolling mass flow is set, the rolling speed of the strip is determined only by the final thickness of the latter.

A first disadvantage of known HSM plants is that the heating of the thick, or conventional slabs, with a starting thickness comprised between 150-350 mm, takes place in heating furnaces which use gas burners to raise the temperature of the product up to about 1250° C. This temperature is necessary because all the temperature losses along the line have to be taken into account so that the strip leaves the last rolling stand at a temperature, as we said, of at least 830° C.

However, the slab heating operation requires long times, for example comprised between 4 and 7 hours, requiring a very high gas consumption by the burners, with consequences on environmental emissions and production costs.

Furthermore, in the case of heating particular steels, the thermal targets can be even higher, with a consequent increase in both gas consumption and emissions. It should also be added that, in order to differentiate the heating according to the type of steel and the required final quality, it is necessary to wait for the correct heating of the furnace to the desired temperature, higher or lower, and this limits production flexibility, given that it will be necessary to organize production to heat products that are thermally similar to each other, so as to try to optimize the times needed to reach the target temperature of the furnace. Due to this, the delivery times of the finished product are lengthened, which is increasingly required in small batches.

Another disadvantage of conventional HSM plants is that it is necessary to limit the maximum speed of the strip exiting from the finishing train in order to prevent the head of the strip, in the path that goes from the last stand to the winding reel 98, from rising dangerously because of aerodynamic-type effects due to speed. Typically, the maximum speed allowed for the head of the strip on the run-out table is about 11-12 m/s; this speed can then be increased after the winding on the winding reel has started.

By head of the strip we conventionally mean the front end of the strip which, in the direction of travel, meets the first stand of the finishing rolling line.

Similarly, by tail of the strip we mean the rear end of the strip which, in the direction of travel, enters the first stand of the finishing rolling line last.

The portion of strip comprised between the head and tail is referred to as the body of the strip.

Because of this speed limitation it may happen that, especially for thin strip, for example with thicknesses of 1.2 mm or less, it is not possible to reach said optimum temperature of at least 830° C. at the outlet of the last finishing stand.

To prevent this from happening, in known plants, after the head enters the winding reel 98, the so-called "speed-up" of the stands of the finishing train 94 is carried out, in order to make the strip transit faster and thus reduce losses in temperature, allowing the body and tail of the strip to exit from the finishing train 94 at the optimum temperature not lower than 830° C.

In fact, the "speed-up" consists in increasing the rotation speed of the rolls of the stands of the finishing train 94, and consequently the rolling speed of the strip, after its head has been wound on the winding reel 98, up to the speed value at which a rolling mass flow sufficient to obtain said optimum temperature at the outlet of the finishing train 94 is obtained. This speed increase is on average 40%/50% and, at times, can even reach 100%.

Therefore, the execution of the speed-up means that the head of the strip is rolled at a first speed (for example 12 m/s) while the body and tail of the strip are rolled at a second speed (for example 17 m/s-18 m/s) higher than the first speed.

This type of solution, if applied for example to the production of a rolled product having a final thickness of 1.2 mm, and as shown schematically in the graph in FIG. 3, requires an increase in speed of the tail of about 40%, in order to guarantee a minimum temperature of 830° C. at exit from the last stand, since the only active heat input coincides solely with the heating furnace upstream of the line.

However, if one wants to obtain rolled products with rolling thicknesses of less than 1.2 mm, despite using a speed-up of even 60%, with which the typically limit speed of 19-20 m/s is reached, with conventional HSM plants it is not possible to guarantee that the desired minimum temperature of 830° C., required at exit from the last stand, is maintained, since the temperature loss of the product being rolled is excessive, with consequent and undesirable phase changes of the steel, which affect the quality of the final product.

As shown schematically in the graph in FIG. 4, with a traditional HSM plant, in order to produce a 1.0 mm thick strip, and a limit speed-up as indicated above, the exit temperature from the last rolling stand is around 780° C., making a quality production for strip of such a limited thickness substantially impossible.

Another disadvantage of known HSM plants concerns the non-optimal disposition of the head-tail trimming shear and the descaling unit which are provided upstream of the finishing train, generally consisting of 6 or 7 compact stands.

In fact, the intermediate product that exits from the reversible roughing stand/s is head trimmed by the shear so as to limit entry problems; however, the thickness of the intermediate product is still quite high, comprised between 35 mm and 45 mm, and therefore the weight of the trimmings is quite high, negatively affecting the yield of the plant.

Furthermore, the shear must have large sizes and capacity, in order to allow the correct execution of the cut which, in general, must have a curvilinear imprint, having a convexity in the direction of feed, so as to facilitate the subsequent entries of the head.

Once the cut has been made, the head begins to undergo the various rolling passes (generally 7 finishing passes) and gradually undergoes an increasing deformation which can lead to the generation of head "tongues" of irregular shape, which can cause failed entries in the last passes of the finisher or in the winding reel, with consequent cobbles and stoppages of the rolling mill.

Since HSM plants work in coil-to-coil mode, every hour there are about 20 entries into each stand which, as the deformation of the head increases, increase the probabilities of cobble, with consequent possible production stops and increased production costs.

Finally, in known HSM plants, the last step of descaling the intermediate product takes place before it enters the finishing train.

Given that descaling causes a lowering of the temperature of the product, carrying it out upstream of a compact finishing train consisting of numerous stands, entails the risk, particularly in the case of thin thicknesses, that the desired minimum temperature of 830° C. is not respected, at exit from the last rolling stand.

Therefore, to avoid this problem, it is known to provide a further thermal increase by the gas heating furnaces located upstream, further aggravating the disadvantages already described above.

To overcome these limitations, solutions have been proposed which provide to carry out induction heating immediately in front of the compact finishing train in order to enter with the bar at a higher temperature, but since the heating is carried out before the initial stands, which are the slowest, a greater amount of scale is formed due to the higher temperature for the same time of exposure to the air of the bar being rolled in the initial stands.

Furthermore, the compact finishing train, in conventional HSM plants, does not allow to carry out a further high-pressure descaling step inside the compact finishing train.

This means that the scale that forms following the exposure to high temperature air of the bar being rolled in the initial passes, since it cannot be removed, is imprinted into the strip during the rolling in the final passes, with a consequent reduction in the quality of the finished product.

It is therefore one purpose of the present invention to provide a Hot Strip Mill plant and to perfect a method for producing flat rolled products which allow to also produce quality strip with a thin thickness from 1.8 mm and lower, to a minimum value comprised between 0.9 and 1.2 mm. Quality must be understood both in terms of the surface quality of the strip and also in terms of the final mechanical characteristics required by the market.

Another purpose of the present invention is to produce thin thicknesses without negatively affecting the productivity of the plant, which can reach up to 6 or more million tons/year.

Another purpose of the present invention is to provide a Hot Strip Mill plant in which it is possible to facilitate the entry of the strip into the finishing stands, limiting the risk of cobble in the rolling stands or of failed windings in the reels.

Another purpose of the present invention is to provide a Hot Strip Mill plant and to perfect a method for producing rolled products which allows to maintain the mechanical and geometric properties uniform along the entire length of the coil produced.

Another purpose of the invention is to provide a plant for producing flat rolled products which has a low manufacturing cost, and which is equipped with a small-size shear.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe evolved and perfected aspects of the independent claims.

In accordance with the above purposes, a rolling plant according to the present invention for producing a steel strip starting from a slab having a determinate starting thickness, comprises:

- at least one heating furnace configured to heat the slab to a determinate starting temperature, for example comprised between about 1100-1150° C. and 1200° C.;
- at least one roughing stand, of the reversible type, which is configured to subject the slab to one or more rolling passes in order to obtain an intermediate rolled product, for example with a thickness comprised between about 45 mm and about 80 mm; and
- a rolling train disposed operatively in line with the roughing stand and configured to reduce the thickness of the intermediate rolled product, until a final strip having a final thickness, even smaller than 1.2 mm, is obtained.

Therefore, the plant is configured as a new generation rolling plant which operates in coil to coil mode, in which the rolled product is obtained starting from single slabs, for example with a thickness comprised between about 150 mm and about 350 mm, with all the operational, dimensional and production characteristics that this type of plant entails.

In accordance with one aspect of the present invention, the finishing rolling train is divided between at least one pre-finishing stand and a plurality of finishing stands.

In particular, the at least one pre-finishing stand is disposed at a minimum distance from the reversible roughing stand, advantageously such that the intermediate rolled product is not operatively engaged with both types of stands simultaneously. Furthermore, the at least one pre-finishing stand is able to reduce the thickness of the intermediate rolled product, in order to obtain a pre-finished rolled product, for example with a thickness comprised between about 10 mm and about 50 mm.

The finishing stands, on the other hand, are configured to reduce the thickness of the pre-finished rolled product, so as to obtain the final strip, for example with a thickness comprised between about 0.9 mm and about 26 mm.

In accordance with another aspect of the present invention, there is provided a rapid heating device consisting of selectively activatable elements which is interposed between the at least one pre-finishing stand and the plurality of finishing stands, so as to heat the pre-finished rolled product.

This heating can occur, advantageously, up to an outlet temperature from the rapid heating device comprised between about 1000° C. and about 1100° C., or in any case a temperature such that, also as a function of the operating and product parameters, the temperature of the final strip, at exit from the last finishing stand, is higher than at least 830° C.

This advantageous aspect of the solution according to the present invention allows the steel to remain substantially in the austenitic range and, therefore, without phase transformations, before exiting the last finishing stand.

Therefore, the plant according to the present invention is of the Hot Strip Mill type which allows to produce quality flat rolled products, even with a thin thickness from 1.8 mm and lower, to a minimum value comprised between 0.9 and 1.2 mm, without negatively affecting the productivity of the plant, which can reach up to 6 million tons/year.

According to another aspect of the present invention, since HSM plants do not provide an upstream connection with a continuous casting machine, the plant comprises at least one warehouse configured to store the slabs coming from other production plants or from other areas of the same plant.

According to another aspect of the present invention, the continuous rolling train comprises from one to three pre-finishing stands and from five to six finishing stands.

According to another aspect of the present invention, the plant comprises at least first descaling means interposed between the heating furnace and the at least one roughing stand, advantageously of the reversible type, second descaling means interposed between the reversible roughing stand and a first of the pre-finishing stands, and advantageously third descaling means interposed between the rapid heating device and a first of the finishing stands.

According to another aspect of the present invention, the at least one reversible roughing stand is in turn equipped with descaling means mounted on board and being an integral part of the stand itself, which are disposed both on the inlet side and also on the outlet side of the stand.

According to another aspect of the present invention, the plant comprises a cutting machine interposed between the pre-finishing stands and the rapid heating device to head and tail trim the pre-finished rolled product. As mentioned, in this segment of the plant, the thickness of the pre-finished rolled product is already reduced sufficiently enough to provide a cutting machine of reduced sizes, for example those of the type known as crop Shear, which have contained production and management costs compared to the traditional shears disposed upstream of the entire rolling finishing train.

The present invention also concerns a rolling method for producing a final strip starting from a slab having a determinate starting thickness, in a rolling plant of the type described heretofore.

According to one aspect of the present invention, the method provides at least one pre-finishing rolling of the intermediate rolled product, by means of at least one pre-finishing stand of the rolling train disposed at a minimum distance from the roughing stand, advantageously reversible, so as to reduce the thickness of the intermediate rolled product and obtain a pre-finished rolled product.

Furthermore, always according to the present invention, the method provides at least one finishing rolling of the pre-finished rolled product, by means of a plurality of finishing stands, so as to reduce the thickness of the pre-finished rolled product and obtain the strip with the desired final thickness.

Furthermore, the method according to the present invention provides at least one step of heating the pre-finished rolled product, by means of a rapid heating device consisting of selectively activatable elements and interposed between the at least one pre-finishing stand and the plurality of finishing stands, so that the temperature of the final strip, in correspondence with the outlet of the last finishing stand, is higher than at least 830° C., even in the case of thin thicknesses.

Advantageously, thanks to the presence of the rapid heating device as above, which allows for an additional active heat input on the pre-finished product, the slabs can be extracted from the gas heating furnace at a temperature lower than 1200° C.; therefore, the residence time of the slabs in the gas heating furnace will be shorter than what provided in known plants. This advantageously reduces the production of scale by 25-30% and, therefore, the losses of scale material are reduced by 25-30%, consequently increasing the yield of the furnace itself.

The installation of the induction heating device between the pre-finishing and finishing stands also allows to relieve the gas heating furnace of a portion of the thermal contribution to be given to the slab, thus reducing gas consumption and emissions. Furthermore, the supplementary thermal power of the induction device is supplied only in the necessary and sufficient amount in a position that is closer to the last stand of the continuous rolling train, rather than being supplied in excess prematurely in the gas furnace in order to deal with the losses of temperature along the line, as instead occurs in the Hot Strip Mills of the state of the art.

Furthermore, the rapid heating device allows to complete the heating of the product to the optimal target value according to the type of steel in a short time, thus being unconstrained to the thermal inertia of the gas furnace.

The rapid heating device is, for example, an inductor with modular elements (or modules) which can be automatically or manually extracted from the rolling line, completely or only partly for some individual elements.

Each module can be activated or deactivated independently from the other modules, and each module can work at different powers.

The number of modules of the inductor is comprised between 6 and 12, preferably between 8 and 10.

Each module has a rated output comprised between 3 MW and 7 MW, preferably between 4 MW and 5 MW.

The overall rated output of the inductor is comprised between 38 MW and 45 MW.

In accordance with one example embodiment, the number of modules is equal to 10, wherein each module has a rated output of 4.3 MW. Therefore the total rated output of the inductor is 43 MW.

According to one aspect of the invention, the activation of the individual modules and the delivery of the available power is governed by a control system as a function of the heat input required to guarantee that the head and tail of each rolled product exit from the last finishing pass at a temperature of at least 830° C. for all workable thicknesses.

In particular, the power delivered mainly depends on the thickness and the final width of the strip to be produced.

In some embodiments, a temperature measurement system is provided before the last two induction modules, preferably infrared, so that these can give any missing temperature to the pre-finished product. Therefore, they are not made to work at maximum power like the previous modules, but are kept switched off or active with reduced power so that they have an adequate margin to integrate any thermal shortages before the product enters the finishing stands (they have a trimming function).

Still to the advantage of the solution according to the present invention, the number of rolling passes to which the slab is subjected in the reversible rolling stand may not exceed five.

In accordance with another aspect of the present invention, the rolling plant provides to produce strips with a final thickness comprised between about 0.9 mm and about 26 mm, which can be wound onto the reels, without speed-up for productions of up to 3 million tons per year, and with moderate speed-up for productions of up to 5 million tons per year.

DESCRIPTION OF THE DRAWINGS

These and other aspects, characteristics and advantages of the present invention will become apparent from the following description of some embodiments, given as a non-restrictive example with reference to the attached drawings wherein.

Figure 1:
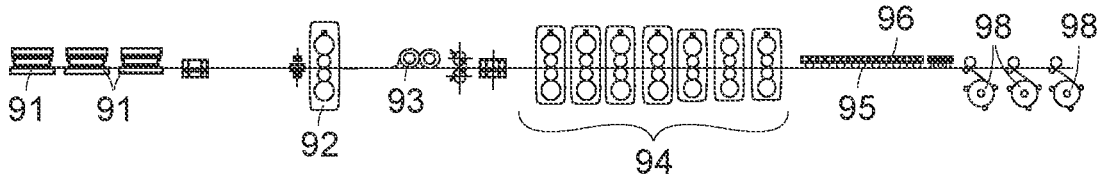
fig. 1 (PRIOR ART)
FIGS. 1 and 2 are schematic representations of two types of HSM plants for producing flat rolled products, in accordance with the prior art.
Figure 2:
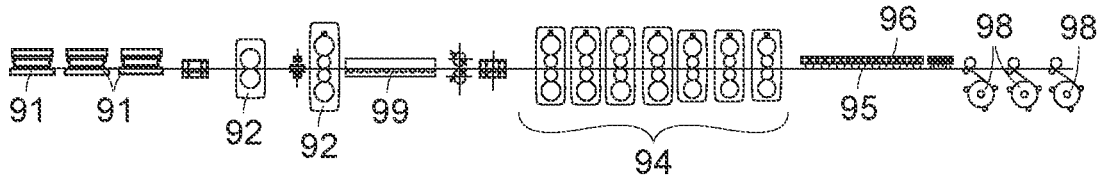
fig. 2 (PRIOR ART)

We must clarify that in the present description the phraseology and terminology used, as well as the figures in the attached drawings also as described, have the sole function of better illustrating and explaining the present invention, their function being to provide a non-limiting example of the invention itself, since the scope of protection is defined by the claims.

To facilitate comprehension, the same reference numbers have been used, where possible, to identify identical common elements in the drawings. It is understood that elements and characteristics of one embodiment can be conveniently combined or incorporated into other embodiments without further clarifications.

DESCRIPTION OF SOME EMBODIMENTS OF THE PRESENT INVENTION

Figure 5:
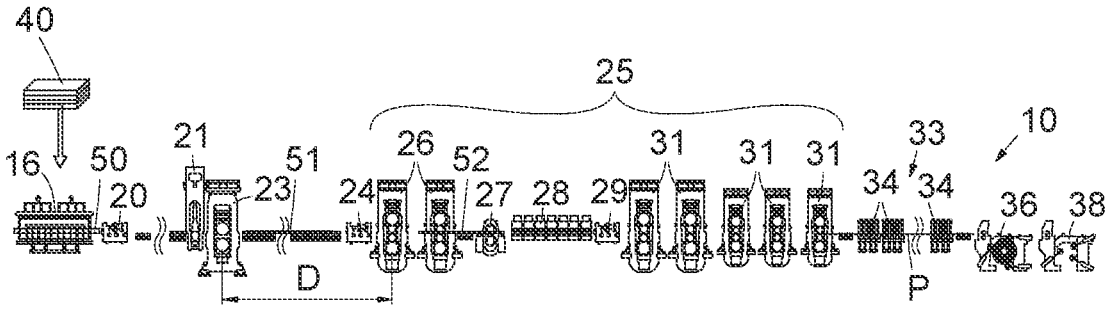
FIG. 5 is a schematic representation of an embodiment of a new generation HSM plant for producing flat rolled products, in accordance with the present invention.

With reference to FIG. 5, this shows a plant 10 in accordance with the present invention, for producing a flat rolled product, for example a final strip P, with a thickness comprised between about 0.9 mm and about 26 mm wound to form a reel, or coil, starting from slabs 50 having a starting thickness comprised between about 150 mm and about 350 mm.

The plant 10 comprises one or more gas heating furnaces 16, for example of the type known in the sector with the term "walking beam", configured to receive and heat to a determinate starting temperature T1 at least one slab 50, supplied even at ambient temperature. Advantageously, at exit from the gas heating furnace 16 the slab 50 has a temperature comprised between about 1100-1150° C. and about 1200° C.

Figure 3:
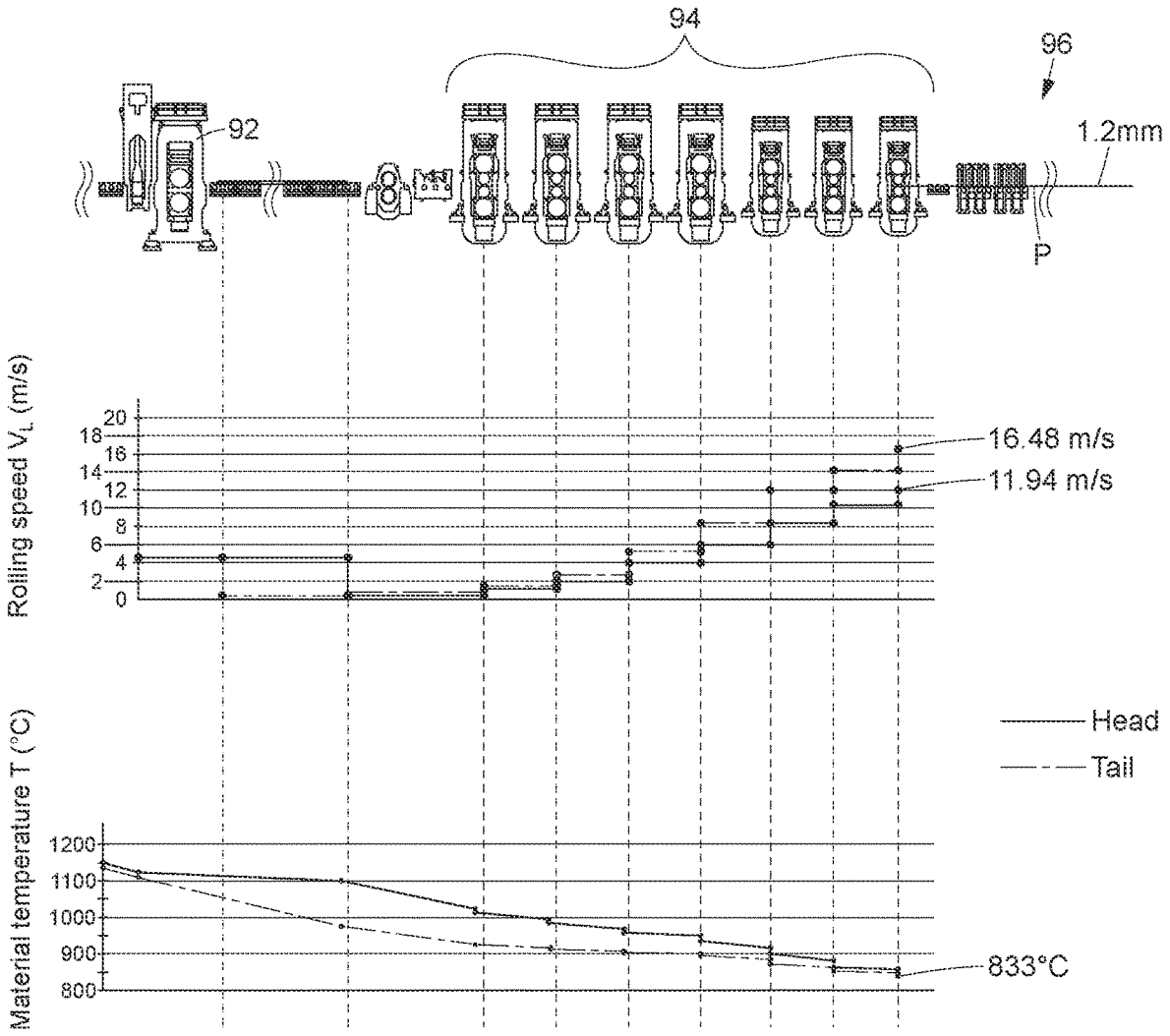
fig. 3 (PRIOR ART)
FIGS. 3 and 4 are graphical representations of the relation between rolling speed and outlet temperature of rolled products with different thicknesses, in accordance with the prior art.
Figure 4:
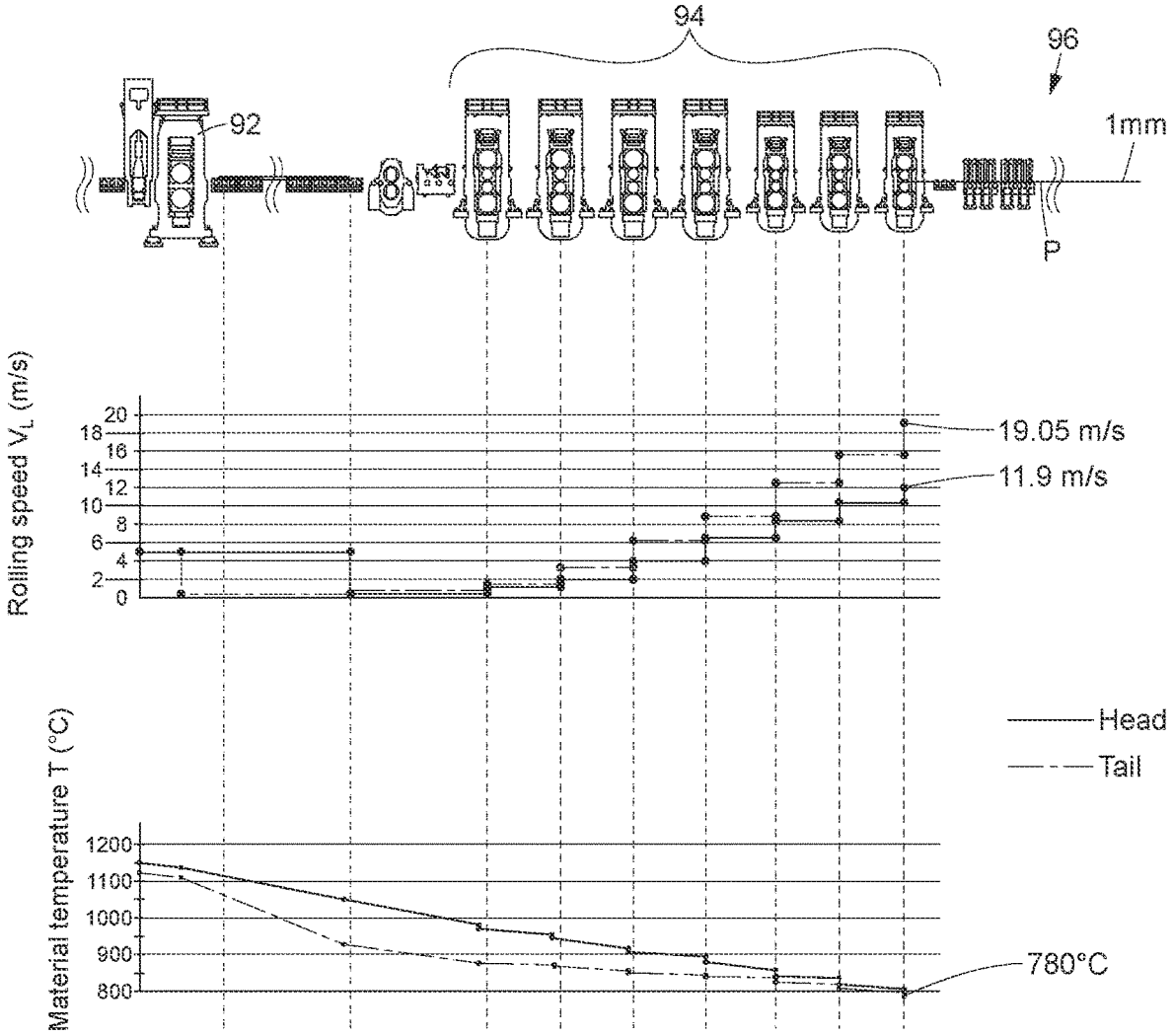
fig. 4 (PRIOR ART)

A warehouse 40 is also part of the plant 10, disposed substantially in line and upstream of the gas heating furnace 16 and configured to store the slabs 50, for example coming from another production site or from another production area of the same factory. The warehouse 40, shown only schematically in FIG. 3, allows to selectively feed at least one slab 50 to the gas furnace 16, according to desired feeding sequences and timings.

Downstream of the gas heating furnace 16 there are disposed, in sequence, a first water descaling device 20, a vertical or edging stand 21 and a reversible roughing stand 23 configured to subject the slab 50 to a determinate number of passes and reduce its thickness until an intermediate rolled product 51 is obtained. The latter, in an advantageous embodiment, has a thickness comprised between about 45 mm and about 80 mm. By way of example only, at the end of the desired roughing passes, the intermediate rolled product 51 has a temperature ranging from about 1020° C. to about 1120° C.

In other embodiments, it is not excluded that two roughing stands 23 may be provided, with corresponding vertical stands 21.

According to another aspect of the present invention, the at least one reversible roughing stand 23 is in turn equipped with descaling means mounted on board and forming an integral part of the stand itself, which are disposed both on the inlet side and also on the outlet side of the stand (not shown in the drawings).

Downstream of the reversible roughing stand 23 there are disposed, in succession, a second descaling device 24 and a continuous rolling train 25.

In particular, the continuous rolling train 25 consists of two macro rolling units, a pre-finishing unit comprising two pre-finishing stands 26 and a finishing unit comprising a plurality of finishing stands 31, in this specific case five.

The continuous rolling train 25 is configured to progressively reduce the thickness of the intermediate rolled product 51 in order to obtain the final strip P, with a minimum thickness of about 1 mm.

In some embodiments, not shown in the drawings, the plant 10 can also comprise a vertical or edging stand 21, both downstream of the reversible roughing stand 23 as well as upstream of the continuous rolling train 25.

In general, the number of pre-finishing stands 26 of the rolling train 25 is comprised between one and three, while the number of finishing stands 31 is comprised between five and six and their number and arrangement is chosen as a function of the steel grades, the use of the finished product and the minimum and maximum thicknesses that the final strip P assumes during rolling.

In the solution according to the present invention, two pre-finishing stands 26 are provided, distanced from the remaining finishing stands 31 of the rolling train 25, so that a pre-finished rolled product 52 having a thickness comprised between about 10 mm and about 50 mm exits from the pre-finishing stands 26.

Furthermore, the pre-finishing stands 26 are disposed at a determinate distance D from the roughing stand 23, so that the intermediate rolled product 51 is never operatively engaged with both types of stand simultaneously.

In the example solution shown, downstream of the pre-finishing stands 26 there is disposed a flying shear 27, of the Crop Shear type, to trim the heads and tails of the pre-finished rolled product 52 in order to facilitate its entry into the finishing stands 31 and to reduce the chances of cobble, especially for the production of final strips having a thickness smaller than 3.0 mm.

Advantageously, since the pre-finished product 52 has a smaller thickness than the corresponding intermediate product 51 of a conventional HSM, the shear 27 can have a smaller size, with benefits in terms of costs, overall dimensions and maintenance.

The plant 10 according to the present invention also comprises a rapid heating device 28 interposed between the pre-finishing stands 26 and the finishing stands 31 of the continuous rolling train 25.

Preferably, the rapid heating device 28 comprises, for example, an induction furnace disposed downstream of the flying shear 27 and consisting of elements that can be activated selectively, even independently of each other.

The rapid heating device 28 is configured to heat, selectively and in an adjustable manner, the pre-finished rolled product 52 before it enters the finishing stands 31.

The temperature to which the pre-finished rolled product 52 is heated is selected, among other parameters, at least as a function of its thickness and the final thickness of the final strip P, so that the latter has an optimum temperature of at least 830° C. at the outlet of the continuous rolling train 25, and in particular at the outlet of the last finishing stand.

By way of example only, the temperature to which the pre-finished rolled product 52 is heated, that is, the temperature it has at exit from the rapid heating device 28, reaches a value advantageously comprised between about 1000° C. and about 1100° C.

This allows to reduce the value of the rolling mass flow $MF_L$ required to obtain the above mentioned optimum temperature of at least 830° C., for example comprised between 830° C. and 900° C., at the outlet of the last finishing stand 31.

The reduction of the required rolling mass flow $MF_L$ reduces the maximum rolling speed required as a whole from the finishing train 25 to obtain the optimum temperature as above. This allows to avoid, or at least reduce, the so-called "speed-up" which occurs, during use, during rolling.

Advantageously, downstream of the rapid heating device 28 and upstream of the finishing stands 31 there is also disposed a third water descaling device 29 which has the function of further cleaning the surface of the pre-finished rolled product of scale before entering the finishing stands 31.

Therefore, the scale which has formed on the surface of the pre-finished rolled product 52 is effectively removed, thus avoiding qualitative defects on the rolled strip P, such as imprinted scale for example.

Downstream of the finishing stands 31 there is disposed a cooling device 33 comprising a plurality of showers 34 which can be selectively activated even independently of each other to cool the strip P.

Furthermore, at exit from the showers 34 there are disposed two winding reels 36, 38 to wind the strip P into coils for its subsequent storage and shipment.

The solution according to the present invention, thanks to the increase in the temperature of the pre-finished rolled product 52, induced by the rapid heating device 28, allows the finishing stands 31 to carry out greater thickness reductions than in the prior art while guaranteeing the outlet temperature from the last finishing stand of at least 830° C.

The fact of being able to make large thickness reductions in the continuous rolling train 25 also allows to equip the plant 10 with a single reversible roughing stand 23, considerably reducing the total cost of the plant.

Another advantage of using only one reversible stand 23 which supplies an intermediate rolled product having a thickness comprised in a range from about 45 mm to about 80 mm, consists in being able to limit the distance between the reversible stand 23 and the continuous rolling train 25, with consequent reduced temperature losses, reduced formation of surface scale and reduction of the overall length of the plant 10. In fact, the plant 10 of the present invention can be a hundred meters shorter than the plants of the prior art, with the same annual production, for example, comprised between about 3 and about 6 million tons per year (Mtpy).

In addition, thanks to the heating supplied by the rapid heating device 28 in correspondence with the continuous rolling train 25, it is possible to limit the heating of the starting slabs 50 in the gas furnace 16 to a temperature of only 1100/1150-1200° C., with the advantage of consuming less combustible gas and limiting emissions compared to known plants.

Furthermore, since the slab 50 is heated to a lower temperature than in the prior art, its residence time in the gas furnace 16 will also be shorter than what provided in known plants. This advantageously reduces the production of scale by 25-30% and, therefore, the losses of scale material are reduced by 25-30%, consequently increasing the yield of the furnace 16 itself.

The present invention also concerns a method for producing a strip P, wound to form a coil, starting from slabs 50 having a starting thickness comprised between about 150 mm and about 350 mm.

The method provides to heat at least one slab 50 in the gas heating furnace 16 to a temperature of 1100/1150-1200° C. and then feed the latter toward the first descaling device 20.

Subsequently, the slab 50 is fed toward the edging stand 21 and then toward the reversible roughing stand 23 in correspondence with which it is subjected to some rolling passes that reduce its thickness until the intermediate rolled product 51 is obtained, having a thickness comprised in a range from about 45 mm to about 80 mm. Preferably, the number of rolling passes performed by the reversible roughing stand 23 does not exceed five.

This reduces the temperature loss of the intermediate rolled product 51 and limits its length, while also reducing the temperature difference between its head and tail.

Then, the intermediate rolled product 51 is transported to the second descaling device 24, where it is subjected to surface descaling and, subsequently, fed toward the continuous rolling train 25.

The intermediate rolled product 51 then enters the pre-finishing stands 26, in which it is further reduced in thickness until the pre-finished rolled product 52 is defined, with a thickness comprised between about 10 mm and about 50 mm.

Thus transformed dimensionally, the pre-finished rolled product 52 is cropped head and tail by the shear 27 and enters the rapid heating device 28 in which it is heated to a temperature such that the final strip P will be at an optimum temperature of at least 830° C. in correspondence with the outlet of the last finishing stand even in the case of thin strips with a thickness comprised between 0.9 mm and 1.2 mm.

In some embodiments, the heating supplied by the rapid heating device 28 is variable, heating the head of the pre-finished rolled product 52 to a determinate temperature and then increasing the heating supplied thereto in a substantially linear manner so that the body and tail of the final strip P can also exit from the last finishing stand 31 of the continuous rolling train 25 at the optimum temperature of at least 830° C.

Thanks to the heating supplied by the rapid heating device, it is possible to reduce the value of the rolling mass flow $MF_L$ required to obtain the optimum temperature of at least 830° C., for example comprised between 830° C. and 900° C., at the outlet of the last finishing stand.

Figure 6:
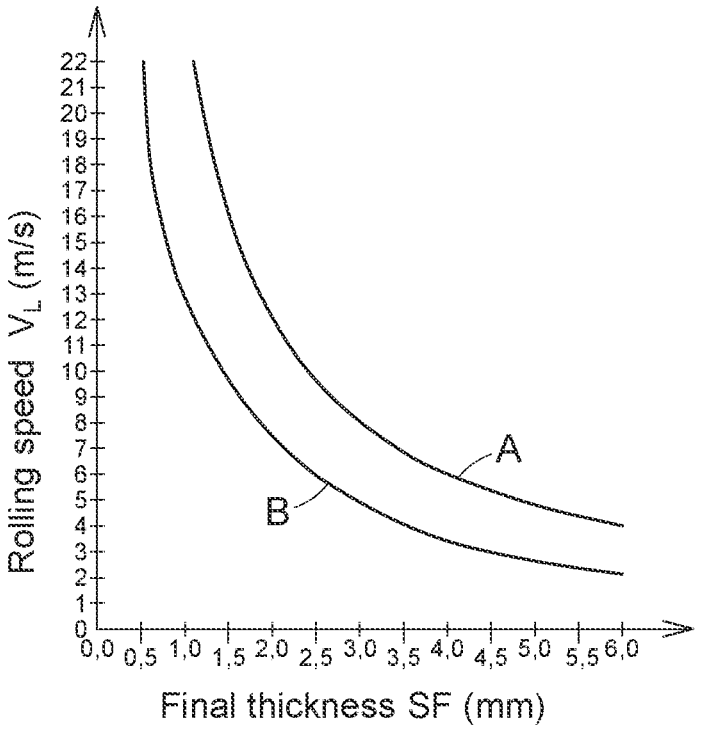
FIG. 6 is a graph which relates, for a defined mass flow, the final thickness of a flat rolled product and the rolling speed required for it.

By way of a purely non-limiting example, we refer to the graph in FIG. 6 which shows the final thickness $S_F$ of the final strip P on the abscissas and the rolling speed $V_L$ on the ordinate. Curve A represents the trend of the required rolling mass flow $MF_L$ as a function of the final thickness $S_F$ without the heat input of the rapid heating device 28. Curve B represents the trend of the required rolling mass flow $MF_L$ as a function of the final thickness $S_F$ with the heat input of the rapid heating device 28.

As evident, the mass flow relating to curve B is lower than the mass flow relating to curve A. In fact, for the same final thickness $S_F$ of the final strip P, the mass flow relating to curve B corresponds to a lower rolling speed $V_L$ than that corresponding to the mass flow relating to curve A.

Figure 7:
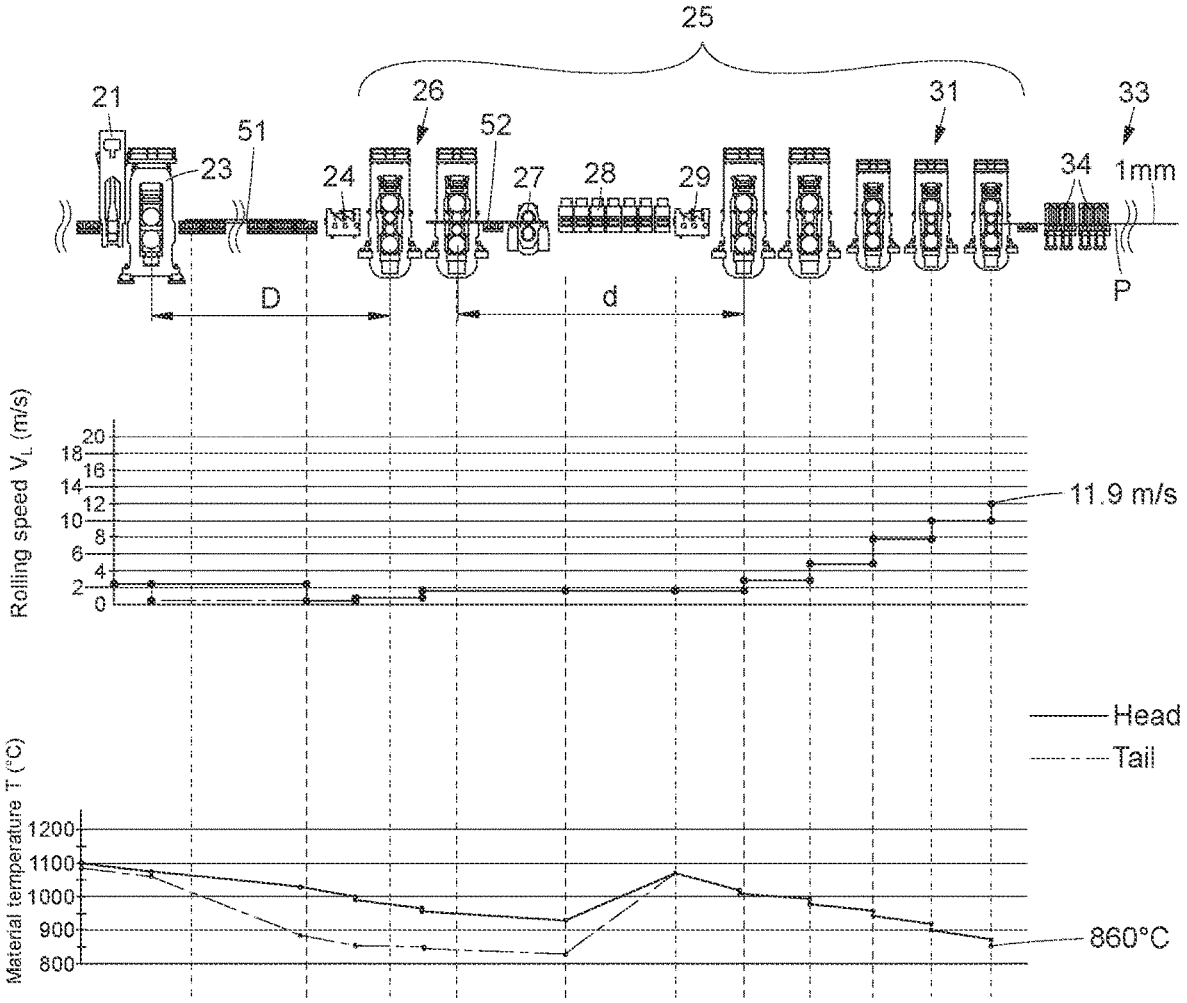
FIGS. 7 and 8 are graphical representations of the relation between rolling speed and outlet temperature of rolled products with different thicknesses of a new generation HSM plant for producing flat rolled products, in accordance with the present invention.

The reduction of the rolling mass flow $MF_L$ allows both to carry out the rolling with a reduced rolling speed $V_L$, preferably lower than 12 m/s, and at the same time to reach the optimum temperature of at least 830° C. at the outlet of the continuous rolling train 25 even for the tail of the final strip P, eliminating the need for the "speed up" as a tool for reaching the target temperature. An example of this embodiment is schematized graphically in FIG. 7.

Advantageously, in the absence of speed-up, the rolling speed $V_L$ in the finishing stands 31 is substantially constant and allows both to maintain the temperature of the final strip P constant between its head and tail, and also to choose the most suitable temperature control (for example thermomechanical treatment) as a function of the steel grade and the use of the final strip P.

Another advantage of not performing the speed-up consists in the fact that it allows a high control of both the final shape of the final strip P, for example crown and flatness thereof, which will therefore be advantageously uniform along the entire length of the coil, and also of the mechanical properties of the final strip P which will be advantageously constant and uniform along the entire length of the coil.

This last advantage, which cannot be achieved with plants of the prior art, is of considerable importance, particularly for quality productions such as, for example, final strips P intended for molding.

Figure 8:
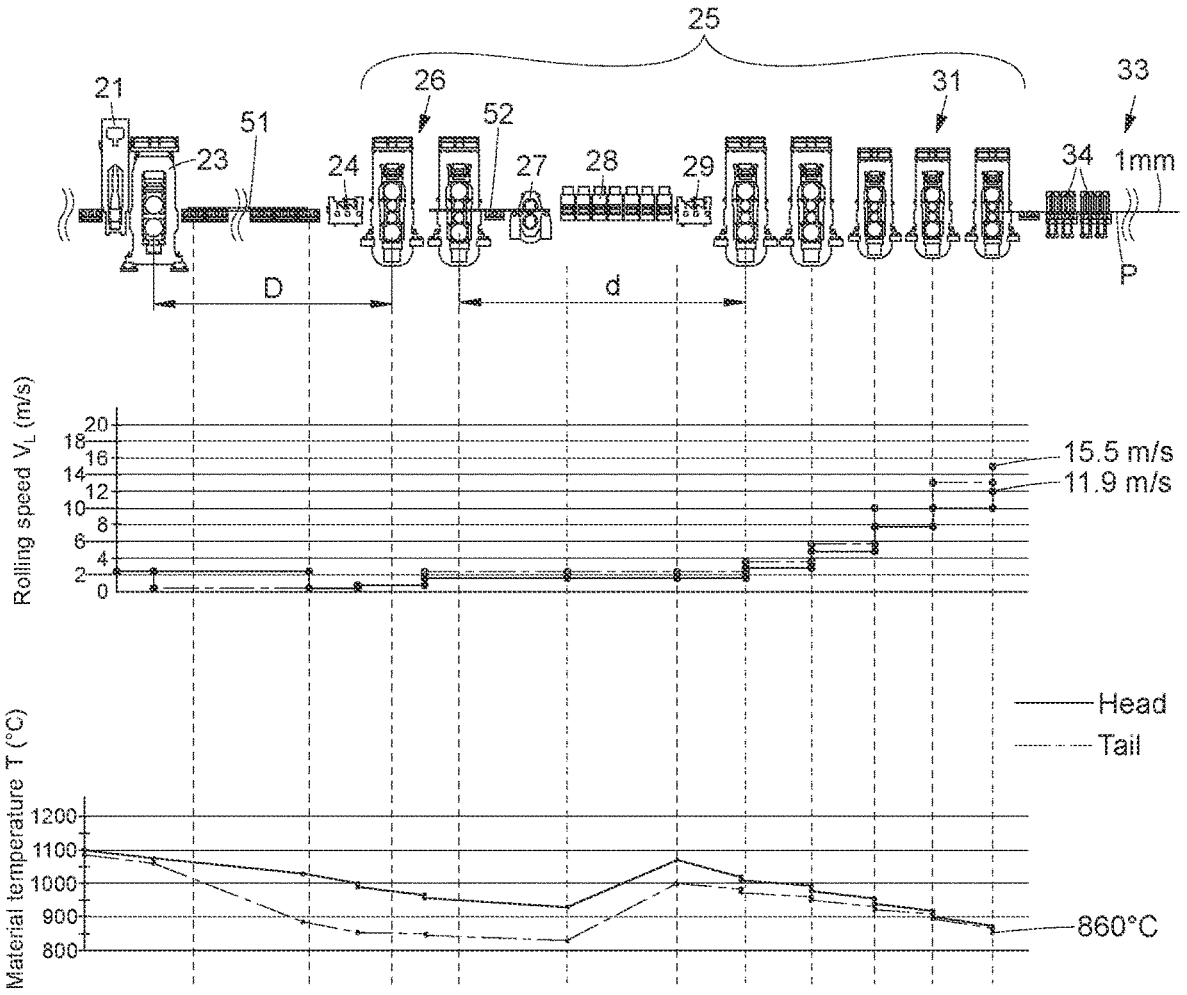

According to some embodiments, it may be necessary to resort to speed-up in order to be able to increase the productivity of the line when very thin thicknesses are produced, or to achieve very high productivity with other thicknesses. An example of this embodiment is schematized graphically in FIG. 8.

Furthermore, according to other embodiments, the speed-up can be implemented in combination with the rapid heating device 28, for example to limit the latter's electrical consumption.

For relatively thick final thicknesses, the speed-up can be implemented keeping the rapid heating device switched off to completely eliminate the latter's electrical consumption.

It is clear that modifications and/or additions of parts may be made to the plant 10 and to the method for producing flat rolled products as described heretofore, without departing from the field and scope of the present invention, as defined by the claims.

It is also clear that, although the present invention has been described with reference to some specific examples, a person of skill in the art shall certainly be able to achieve many other equivalent forms of method and plant 10 for producing flat rolled products, having the characteristics as set forth in the claims and hence all coming within the field of protection defined thereby.

In the following claims, the sole purpose of the references in brackets is to facilitate their reading and they must not be considered as restrictive factors with regard to the field of protection defined by the same claims.

The invention claimed is:

1. A rolling plant, for producing a final strip starting from a slab having a determinate starting thickness, comprising:

at least one heating furnace configured to heat at least said slab to a determinate starting temperature between about 1100° C. and 1200° C.;

at least one reversible roughing stand configured to subject said slab to one or more rolling passes in order to obtain an intermediate rolled product;

a continuous rolling train disposed operatively in line with said at least one roughing stand and configured to reduce the thickness of said intermediate rolled product, until said final strip having a determinate final thickness is obtained;

wherein said rolling train comprises at least one pre-finishing stand disposed at a minimum distance D from said roughing stand so that the intermediate rolled product is never operatively engaged with one roughing stand of the at least one roughing stand and simultaneously engaged with one pre-finishing stand of the at least one pre-finishing stand, and wherein the at least one pre-finishing stand is able to reduce the thickness of said intermediate rolled product in order to obtain a pre-finished rolled product, and a plurality of finishing stands able to reduce the thickness of said pre-finished rolled product in order to obtain said final strip, and wherein a rapid heating device consisting of selectively activatable elements, the selectively activatable elements together having a total rated output between 38 MW and 45 MW, is interposed between said at least one pre-finishing stand and said plurality of finishing stands, and is configured to heat said pre-finished rolled product so that a target temperature of said final strip, in correspondence with the outlet of the last finishing stand of said rolling train, is higher than at least 830° C., even for a final thickness <1.2 mm, and wherein a rolling speed in said plurality of finishing stands is lower than 12 m/s in order to reduce or eliminate a need for a speed-up as a tool for reaching said target temperature.

2. The plant as in claim 1, wherein it comprises at least one warehouse configured for the storage of said slabs, said warehouse being disposed substantially upstream of said heating furnace and able to selectively feed at least one of said slabs to said heating furnace.

3. The plant as in claim 1, wherein said rolling train comprises from one to three pre-finishing stands and from five to six finishing stands.

4. The plant as in claim 1, wherein said at least one roughing stand is configured to define said intermediate rolled product having a thickness comprised between 45 mm and 80 mm, wherein said at least one pre-finishing stand is configured to define said pre-finished rolled product having a thickness comprised between 10 mm and 50 mm, and wherein said plurality of finishing stands are configured to define said final strip having a determinate final thickness comprised between about 0.9 mm and about 26 mm.

5. The plant as in claim 1, wherein it comprises at least first descaling means interposed between said heating furnace and said at least one roughing stand, second descaling means interposed between said roughing stand and a first of said pre-finishing stands, and third descaling means interposed between said rapid heating device and a first of said plurality of finishing stands.

6. The plant as in claim 1, wherein it comprises a cutting machine interposed between said pre-finishing stand and said rapid heating device.

7. A rolling method, for producing a final strip starting from a slab having a determinate starting thickness, in a rolling plant which comprises:

at least one heating furnace configured to heat at least said slab to a determinate starting temperature T1 between about 1100° C. and 1200° C.;

at least one reversible roughing stand configured to subject said slab to one or more rolling passes in order to obtain an intermediate rolled product;

a continuous rolling train disposed operatively in line with said at least one roughing stand and configured to reduce the thickness of said intermediate rolled product, until said final strip having a determinate final thickness is obtained;

wherein said method comprises at least one pre-finishing rolling of said intermediate rolled product, by means of at least one pre-finishing stand of said rolling train disposed at a minimum distance D from said roughing stand so that the intermediate rolled product is never operatively engaged with one roughing stand of the at least one roughing stand and simultaneously engaged with one pre-finishing stand of the at least one pre-finishing stand, and wherein the at least one pre-finishing stand reduces the thickness of said intermediate rolled product in order to obtain a pre-finished rolled product, at least one finishing rolling of said pre-finished rolled product, by means of a plurality of finishing stands of said rolling train which are able to reduce the thickness of said pre-finished rolled product, in order to obtain said final strip, and at least one step of heating said pre-finished rolled product, by means of a rapid heating device consisting of selectively activatable elements, the selectively activatable elements together having a total rated output between 38 MW and 45 MW, and interposed between said at least one pre-finishing stand and said plurality of finishing stands, so that a target temperature of said final strip, in correspondence with the outlet of the last finishing stand of said rolling train, is higher than at least 830° C., even for a final thickness <1.2 mm, and wherein a rolling speed in said plurality of finishing stands is lower than 12 m/s in order to reduce or eliminate a need for a speed-up as a tool for reaching said target temperature.

8. The method as in claim 7, wherein it comprises at least one storage and feeding step in which, by means of a warehouse disposed substantially upstream of said heating furnace, said slabs are stored and fed selectively toward said heating furnace.

9. The method as in claim 7, wherein the thickness of said intermediate rolled product in correspondence with the inlet of said rolling train is comprised in a range from 45 mm to 80 mm.

* * * * *